United States Patent [19]

Jeschke

[11] Patent Number: 4,572,072

[45] Date of Patent: Feb. 25, 1986

[54] DEVICE FOR EXCHANGING PRINTING MEDIUM BETWEEN ZONES OFFSET WITH RESPECT TO ONE ANOTHER IN LONGITUDINAL DIRECTION OF A ROLLER IN A PRINTING UNIT OF A ROTARY PRINTING MACHINE

[75] Inventor: Willi Jeschke, Heidelberg, Fed. Rep. of Germany

[73] Assignee: Heidelberger Druckmaschinen AG, Heidelberg, Fed. Rep. of Germany

[21] Appl. No.: 447,949

[22] Filed: Dec. 8, 1982

[30] Foreign Application Priority Data

Dec. 9, 1981 [DE] Fed. Rep. of Germany ..... 3148667

[51] Int. Cl.[4] ..... B41F 31/14

[52] U.S. Cl. ..... 101/348; 101/DIG. 8

[58] Field of Search ..... 101/348–350, 101/DIG. 7, DIG. 8; 400/470, 471, 471.1, 202.2, 202.3; 118/250, 251

[56] References Cited

U.S. PATENT DOCUMENTS

| | | | |
|---|---|---|---|
| 1,077,882 | 11/1913 | Holz | 101/DIG. 8 |
| 1,715,741 | 6/1929 | Claybourn | 101/DIG. 8 |
| 2,904,813 | 9/1959 | Schleicher | 101/348 |
| 3,903,793 | 9/1975 | Schubert | 118/251 |
| 4,033,262 | 7/1977 | Johne et al. | 101/350 |
| 4,290,362 | 9/1981 | Köbler et al. | 101/350 |
| 4,350,094 | 9/1982 | Fischer | 101/350 |

FOREIGN PATENT DOCUMENTS

| | | | |
|---|---|---|---|
| 143459 | 10/1951 | Australia | 101/DIG. 7 |

OTHER PUBLICATIONS

Bonafino, "Contoured Surface Ink Roller" IBM Technical Disclosure Bulletin, vol. 20, No. 4, p. 1337, 9/77.

*Primary Examiner*—William Pieprz

*Attorney, Agent, or Firm*—Herbert L. Lerner; Laurence A. Greenberg

[57] ABSTRACT

Device for exchanging printing medium between zones offset with respect to one another in longitudinal direction of at least one roller in a printing unit of a rotary printing press, including at least one rotational body for exchanging and distributing the printing medium, the rotational body having a rotational axis out of parallel with the one roller of the printing unit and having an enveloping surface correspondingly out of parallel with the one roller and contacting the one roller at least indirectly at zones thereof offset from one another.

2 Claims, 5 Drawing Figures

DEVICE FOR EXCHANGING PRINTING MEDIUM BETWEEN ZONES OFFSET WITH RESPECT TO ONE ANOTHER IN LONGITUDINAL DIRECTION OF A ROLLER IN A PRINTING UNIT OF A ROTARY PRINTING MACHINE

The invention relates to a device for exchanging printing medium i.e. ink and/or dampening medium, between zones offset with respect to one another in the longitudinal direction of a roller in a printing unit of a rotary printing machine.

In rotary printing machines, a satisfactory printing process is often disturbed by the formation of different ink film thicknesses on the rollers. Thus, for example, in offset rotary printing machines, the problem of "ink build-up" is known. Excessive emulsification of water in ink is involved therein. The mixture builds up, and in fact on the inking-unit and dampening-unit rollers. This results locally in the formation of a very thick film which cannot readily be worn down by ink splitting and lateral distribution. The result is a strip-wise different ink control on the rollers with printing difficulties.

This phenomenon is caused, for example, by the fact that it is conventional to use printing materials of different width. The width of the printing machine and, thus, the length of the inking-unit and dampening-unit rollers as well as of the printing-unit cylinders must be adapted to the maximum width of the sheet or the paper web. The rollers and cylinders are usually dampened over the entire width thereof. This results nearly inevitably in an excess of dampening solution at the edge zones of the rollers when very narrow sheets or web widths are being printed. A consequence thereof is the formation of a build-up of ink-water emulsion at the hereinaforementioned non-printing edge zones.

Various devices have become known heretofore which have the common goal of preventing this phenomenon from occurring.

Thus, it has become known heretofore from German Published Non-Prosecuted Application (DE-OS) No. 24 12 412, how, in the delivery direction of the ink, at least one transfer roller of the inking unit adjacent the first distributor roller is provided with a profiled outer cylindrical surface causing an axial, inward displacement of the ink film.

A further measure in this context is known, moreover, from German Published Non-Prosecuted Application (DE-OS) No. 26 59 557 wherein for the purpose of additionally increasing or intensifying the axial ink transfer and for making the ink-water emulsion more uniform, the distributor roller, which is provided with a profiled outer cylindrical surface, is driven at a peripheral speed which differs from the peripheral speed of the plate cylinder.

A disadvantage common to both of the aforementioned prior-art devices, above all, is that due to them the ink control or guidance as a whole is shifted to the side. Furthermore, these heretoforeknown devices cannot be used selectively at individual critical points and, in addition, are extremely difficult to clean. These devices do not take into account the fact that the ink build-up occurs only at very limited points which exhibit great differences in the ink locally, for example when printing a frame around a picture. Due to the additional drive of the distributor roller in German Published Non-Prosecuted Application (DE-OS) No. 26 59 557, there is an increase in the space and energy required. This is also linked to further heating.

Finally, mention should be made of German Published Prosecuted Application (DE-AS) No. 30 14 144. This publication describes a device for applying a liquid to the plate cylinder of a rotary printing machine with several parallel rollers. In this device, disposed above one another in axially parallel planes between two axially parallel deflection rollers are two inclined guide rods, and a conveyor belt in the form of a closed loop extending with an upper run thereof at least once in a spiral about the upper guide rod and with a lower run thereof at least once in a spiral about the lower guide rod, and further extending, at each reversal of direction thereof, around appropriate deflection rollers so that when the deflection rollers are brought into contact with rollers rotating in the same direction there is an inclined or sloping transfer of the liquid from the first roller to the second roller.

Such a device neither permits an axial transfer of printing medium on the same roller nor is it suitable for contacting rollers since it can only mutually connect rollers having the same rotational direction. Moreover, an essential disadvantage is the danger of fouling of the belt since it is scarcely possible to prevent the printing medium from depositing under the belt.

It is accordingly an object of the invention to provide a device for exchanging printing medium in the longitudinal direction of the roller in a printing unit of a rotary printing machine with which it is also possible, within a locally, narrowly restricted region to have, for example, an exchange of printing medium i.e. ink and/or dampening medium, between non-printing roller regions and such roller regions onthe same or another roller which are used for the printing process or in which more ink or dampening medium is required. Furthermore, the device makes additional distribution in the circumferential direction of the rollers possible in order thereby to break up any detrimental emulsion.

Another object of the invention is to provide such a device having a high degree of flexibility with regard to application potential. Thus, the exchange of printing medium can take place both on the same roller as well as on other rollers having directions of rotation which are the same or opposite one another.

It is a further object of the invention to provide such a device which is usable selectively at individual critical points of the printing unit without any resulting side shifting of the ink guidance altogether; and yet another special object of the invention is to provide such a device which has very little danger of becoming fouled.

An additional object of the invention is to provide such a device which can be brought into and taken out of operation by means of appropriate holding devices and are adjustable to the desired roller sections so that adaptation to the most varied printing conditions is possible.

With the foregoing and other objects in view, there is provided, in accordance with the invention, a device for exchanging printing medium between zones offset with respect to one another in longitudinal direction of at least one roller in a printing unit of a rotary printing press, comprising at least one rotational body for exchanging and distributing the printing medium, the rotational body having a rotational axis out of parallel with the one roller of the printing unit and having an enveloping surface correspondingly out of parallel with the one roller and contacting the one roller at least indirectly at zones thereof offset from one another.

In accordance with another feature of the invention, the enveloping surface is in direct contact with the one roller in the printing unit.

In accordance with a further feature of the invention, there are provided two of the rotational bodies formed as tapered rollers, and a support arm carrying the tapered rollers so that the rotational axes thereof are perpendicular to one another, the tapered rollers having respective tapered surfaces in contact with one another and with the one roller in the printing unit.

In accordance with an additional feature of the invention, the rotational body is formed as a disc having an end face extending with a slight angular offset in a plane disposed substantially parallel to the longitudinal axis of the one roller in the printing unit so as to determine the direction of rotation of the disc.

In accordance with an added feature of the invention the rotational body is formed as a disc in contact with the one roller in the printing unit through the intermediary of cylindrical rollers, the rotational axis of the disc being perpendicular to the longitudinal axis of the one roller.

In accordance with a further feature of the invention there are provided two of the rotational bodies rotatable counter to one another, the two rotational bodies being formed as two tapered rollers, a holding device carrying the tapered rollers in a manner wherein the tapered rollers are disposed in contact with one another and having mutually parallel rotational axes, each of the tapered rollers being rollable on one another and on a respective roller in the printing unit.

In accordance with again another feature of the invention, the holding device for the tapered rollers comprises a swivel arm displaceable on a traverse, the traverse being rotatable about the longitudinal axis thereof, the swivel arm having a holding plate at a lower end thereof, the holding plate carrying bearing elements for supporting the tapered rollers.

In accordance with a concomitant feature of the invention, there are provided two rollers in the printing unit rotatable in the same direction, the two tapered rollers being in contact indirectly with one another through the intermediary of a cylindrical roller and being in contact directly with the two rollers, respectively, in the printing unit.

Due to the unequal peripheral speeds of the rotating surfaces, when there is contact with the rollers, differential speeds result which lead, in a particularly advantageous manner, also to a distribution in the circumferential direction.

Other features which are considered as characteristic for the invention are set forth in the appended claims.

Although the invention is illustrated and described herein as embodied in a device for exchanging printing medium between zones offset with respect to one another in longitudinal direction of a roller in a printing unit of a rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
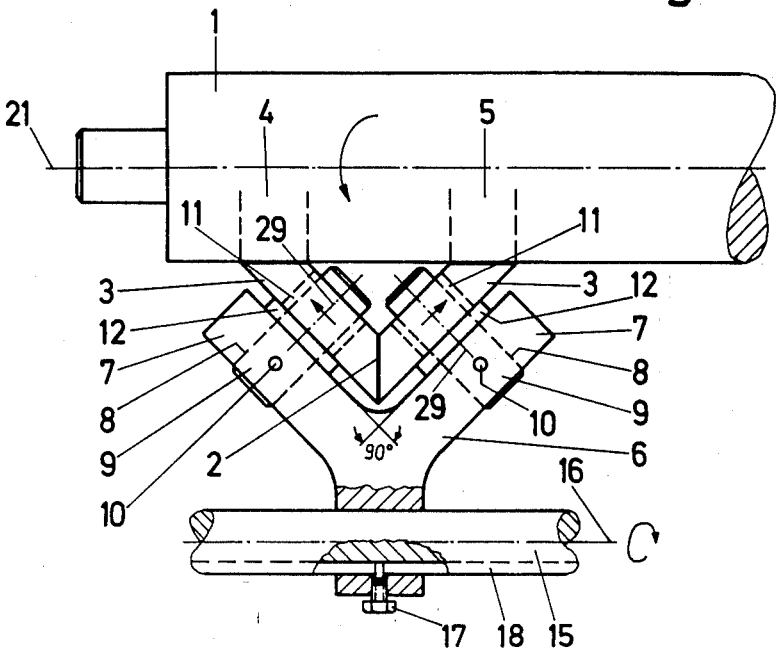
FIG. 1 is a diagrammatic side elevational view, partly broken away and partly in section, of a first embodiment of the device according to the invention which is formed basically of two tapered rollers disposed in mutual contact.

Referring now to the figures of the drawing, it is noted that all of the embodiments of the device according to the invention illustrated therein are used in an inking unit. The embodiments shown in FIGS. 1, 2 and 3 are suitable for exchanging ink and/or dampening medium on the same inking-unit roller.

In FIG. 1, tapered surfaces 2 of tapered rollers 3 are disposed in contact with one another as well as with an inking-unit roller 1 so as to permit an exchange of ink and/or dampening medium between zones 4 and 5 on the inking-unit roller 1. The two tapered rollers 3 are disposed against one another in accordance with the cone angle or angle of taper thereof. Both tapered rollers 3 are held by a Y-shaped support arm 6 having a separation or spreading angle of 9O°. Bores 8 machined into the two branches 7 of the support arm 6 each bear a trunnion or journal pin 9 which is fixed against turning. A pin 10 is used to ensure against turning thereof. The journal pins 9 serve to carry the two tapered rollers 3, appropriate bearing bushings 11 being further provided. The position of the tapered rollers 3 is fixed by spacer rings 12.

In order to be able to bring the entire device respectively into and out of engagement with the inking-unit roller 1, and in order to be able to change the areas of ink exchange over the length of the inking-unit roller, respectively, the support arm 6 is longitudinally displaceable on a cross-member or traverse 15. The traverse 15 is rotatable about the longitudinal axis 16 thereof. A clamping screw 17 disposed at the underside of the support arm 6, as viewed in FIG. 1, projects into a groove 18 machined in the cross-member or traverse 15. By means of this positive, so-called form-locking connection, the support arm with the tapered rollers 3 supported thereon can then be swivelled. Furthermore, after the support arm 6 has been axially set, it can be locked by tightening the clamping screw 17. The tapered rollers 3 exhibit different circumferential speeds on the tapered surfaces thereof so that when they roll on the inking-unit roller 1, speed differences occur which result in a distribution of the dampening medium and/or the ink in circumferential direction of the roller.

Figure 2:
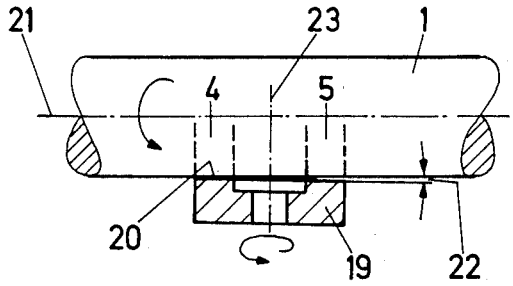
FIG. 2 is a similar view of another embodiment of the invention wherein a disc is used as a rotational body.
Figure 3:
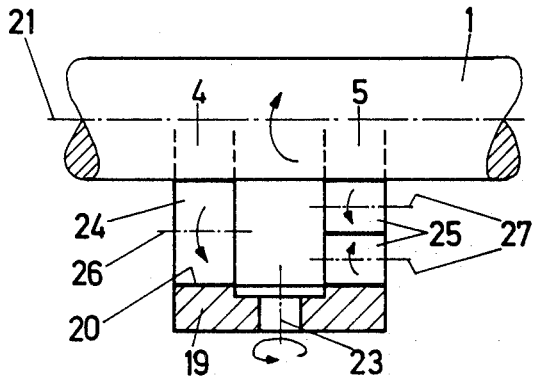
FIG. 3 is a similar view of a further configuration of the disc with intermediate cylindrical roller.

FIG. 2 shows a rotational body in the form of a disc 19. The disc 19 is in contact with the inking-unit roller 1 in such a way that the end face 20 of the disc 19 extends approximately parallel to the longitudinal axis 21 of the inking-unit roller 1. The slight, empirically determinable angular offset 22 establishes the direction of rotation of the disc 19 due to the corresponding friction torque when contact is made with the inking-unit roller 1. In order to attain an appropriate friction-torque difference, it would also possibly be sufficient for the application of the contact force of the disc 19 on the inking-unit roller 1 to be along a line which does not coincide with the rotational axis 23 of the disc 19, but rather, is laterally offset therefrom. The angular offset 22 would thereby by almost zero.

While the disc 19 rotates, an exchange of ink and/or dampening medium takes place between the two zones 4 and 5 of the inking-unit roller 1.

For the purpose of displacing the disc 19 in longitudinal direction of the roller as well as for bringing the disc 19 into and out of engagement, the disc 19 can be mounted on a traverse or crossmember by means of otherwise non-illustrated bearing elements, in accordance with the embodiment of FIG. 1. A distribution of the dampening medium or the ink in circumferential direction of the roller is also possible with the disc 19, because the contact surfaces thereof in engagement with the inking-unit roller 1 have different circumferential speeds due to the differing radial distances thereof from the rotational axis 23.

FIG. 3 shows a further, diagrammatically represented embodiment of the disc 19 wherein the rotational axis 23 thereof is perpendicular to the longitudinal axis 21 of the inking-unit roller 1. The exchange of ink and/or dampening medium occurs in this case through the intermediary of cylindrical rollers 24 and 25 having longitudinal axes 26 and 27 which extend parallel to the longitudinal axis 21 of the roller 1.

Figure 4:
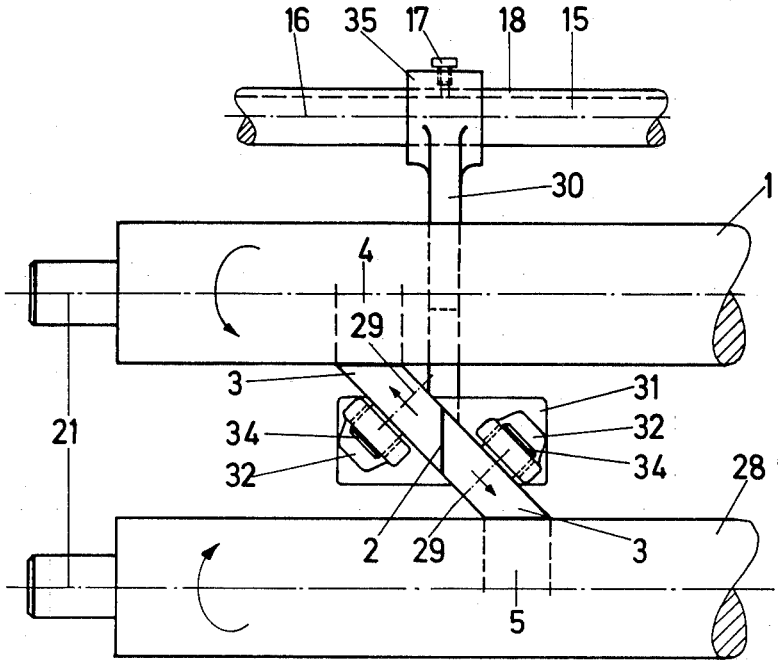
FIG. 4 is a similar view of yet another embodiment of the invention wherein tapered rollers are provided for exchanging ink and/or dampening medium between two counter-rotating rollers.

FIG. 4 shows an embodiment of the rotational bodies in the form of tapered rollers 3 for exchanging ink and/or dampening medium between two counter-rotating rollers 1 and 28. For this purpose, the tapered surface 2 of the two tapered rollers 3 are disposed against one another in such a way that the rotational axes 29 thereof extend in parallel. Owing to the further contact of the tapered surfaces 2 of the tapered rollers 3 with the two inking-unit rollers 1 and 28, an exchange of ink between both rollers occurs, on the one hand, and the zones 4 and 5 of the ink exchange are displaced with respect to one another, on the other hand. The width and the lateral offset of the zones 4 and 5 could be changed, for example, by the appropriate choice of the taper angle and the diameter of the tapered roller.

In the embodiment according to FIG. 4, a swivel arm 30 is also mounted on a traverse or cross-member 15. The lower end of the swivel arm 30 is provided with a holding plate 31. Dlsposed on the holding plate 31 are bearing elements 32 for receiving or holding journal pins 34 of the tapered rollers 3.

Also in this embodiment of FIG. 4, the possibility is thus once again provided for displacing the arrangement in longitudinal direction of the roller and for bringing it into and out of engagement. The clamping screw 17 provided on the swivel-arm bearing 35 cooperates, in this case also, as in the other embodiments, with the groove 18 machined into the traverse or cross-member 15.

Figure 5:
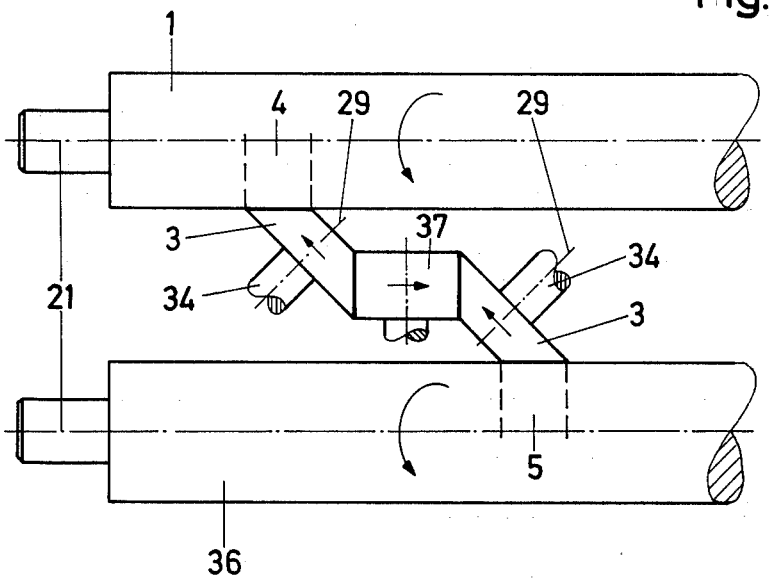
FIG. 5 is a similar view of an additional embodiment of the invention wherein tapered rollers are provided for exchanging ink and/or dampening medium between two rollers rotating in the same direction.

FIG. 5 shows a further possible configuration of the tapered rollers for exchanging ink and/or dampening medium between two rollers 1 and 36 rotating in the same direction. In order to achieve appropriate matching of the directions of rotation, in addition to the two tapered rollers 3 according to the embodiment of FIG. 4, an additional cylindrical roller 37 is necessary. The holding device for such a configuration, also for the purpose of swivelling and displacement, respectively, in axial direction, corresponds basically to the holding device according to FIG. 4. It is merely necessary to have a further bearing element to receive or take up the cylindrical roller 37.

The invention is not restricted to the embodiments shown. It is quite conceivable to provide other rotational bodies e.g. hyperbolic rollers or appropriate planar surface forms of the disc, and to bring them into contact with the rollers via appropriate holding devices in order to obtain an appropriate exchange of ink and/or dampening medium. It is possible, for example, also for several such devices to be assembled on the same traverse or cross-member. Instead of effecting the bringing into and out of engagement by swivelling, it may also be effected, for example, in such a way that a linear movement of the device is attained by means of an appropriate displacing device.

I claim:

1. Device for exchanging printing medium between zones offset with respect to one another in longtudinal direction of at least one roller in a printing unit of a rotary printing press, comprising at least one rotational body for exchanging and distributing the printing medium, said rotational body having a rotational axis out of parallel with the one roller of the printing unit and having an annular contact surface out of parallel with the axis of the one roller and contacting the one roller at least indirectly at zones thereof offset from one another, said rotational body being formed as a disc, and said annular contact surface being an end face of said disc extending substantially perpendicularly to the axis of rotation of said disc, said annular contact surface extending with angular offset in a plane disposed out of parallel with the longitudinal axis of the one roller in the printing unit so as to determine the direction of rotation of said disc, the angular offset permitting at least indirect contact between the one roller and said rotational body through the printing medium being exchanged and distributed.

2. Device for exchanging printing medium between zones offset with respect to one another in longitudinal direction of at least one roller in a printing unit of a rotary printing press, comprising at least one rotational body for exchanging and distributing the printing medium, said rotational body having a rotational axis out of parallel with the one roller of the printing unit and having an annular contact surface extending substantially perpendicularly to the rotational axis of said rotational body and contacting the one roller at zones thereof offset from one another, said rotational body being formed as a disc in contact with the one roller in the printing unit through the intermediary of cylindrical rollers, the rotational axis of said disc being perpendicular to the longitudinal axis of the one roller.

* * * * *